US010041190B2

(12) United States Patent
Waldbauer, Jr. et al.

(10) Patent No.: US 10,041,190 B2
(45) Date of Patent: Aug. 7, 2018

(54) FABRIC INCLUDING POLYOLEFIN ELASTIC FIBER

(71) Applicant: INVISTA North America S.a r.l., Wilmington, DE (US)

(72) Inventors: Robert O. Waldbauer, Jr., Waynesboro, VA (US); Young D. Nguyen, Crozet, VA (US); Hong Liu, Waynesboro, VA (US); James Michael Lambert, Staunton, VA (US)

(73) Assignee: INVISTA NORTH AMERICA S.A.R.L., Wilmington, DE (US)

( * ) Notice: Subject to any disclaimer, the term of this patent is extended or adjusted under 35 U.S.C. 154(b) by 46 days.

(21) Appl. No.: 14/245,051

(22) Filed: Apr. 4, 2014

(65) Prior Publication Data

US 2014/0217648 A1 Aug. 7, 2014

Related U.S. Application Data

(62) Division of application No. 12/969,701, filed on Dec. 16, 2010, now abandoned.

(60) Provisional application No. 61/289,790, filed on Dec. 23, 2009.

(51) Int. Cl.

| | |
|---|---|
| ***D01D 5/00*** | (2006.01) |
| ***D01D 5/08*** | (2006.01) |
| ***D01D 5/088*** | (2006.01) |
| ***D02G 3/32*** | (2006.01) |

(52) U.S. Cl.

CPC ..... *D01D 5/08* (2013.01); *D01D 5/00* (2013.01); *D01D 5/088* (2013.01); *D02G 3/32* (2013.01); *Y10T 428/249921* (2015.04)

(58) Field of Classification Search

USPC ..... 442/329, 340, 345, 346; 428/364, 374, 428/394; 264/477, 103

See application file for complete search history.

(56) References Cited

U.S. PATENT DOCUMENTS

| | | | | |
|---|---|---|---|---|
| 4,364,998 | A * | 12/1982 | Wei | D02G 1/165 428/397 |
| 4,540,753 | A | 9/1985 | Cozewith et al. | |
| 5,153,157 | A | 10/1992 | Hlatky et al. | |
| 5,241,025 | A | 8/1993 | Hlatky et al. | |
| 5,324,576 | A * | 6/1994 | Reed | D04H 1/565 156/167 |
| 6,218,011 | B1 * | 4/2001 | Raetzsch | D01F 1/10 428/364 |
| 6,342,565 | B1 | 1/2002 | Cheng et al. | |
| 6,525,157 | B2 | 2/2003 | Cozewith et al. | |
| 6,559,262 | B1 | 5/2003 | Waymouth et al. | |
| 6,770,713 | B2 | 8/2004 | Hanke et al. | |
| 6,881,800 | B2 | 4/2005 | Friedersdorf | |
| 7,232,871 | B2 | 6/2007 | Datta et al. | |
| 2005/0215964 | A1 | 9/2005 | Autran et al. | |
| 2006/0199006 | A1 | 9/2006 | Poon et al. | |
| 2008/0116096 | A1 * | 5/2008 | Johnson | A45D 34/04 206/459.5 |
| 2009/0264038 | A1 * | 10/2009 | Boscolo | B32B 27/02 442/329 |
| 2009/0298964 | A1 * | 12/2009 | Jacob et al. | 522/78 |
| 2010/0124864 | A1 * | 5/2010 | Dharmarajan et al. | 442/401 |
| 2011/0151233 | A1 | 6/2011 | Waldbauer, Jr. et al. | |
| 2011/0152462 | A1 | 6/2011 | Liu et al. | |

FOREIGN PATENT DOCUMENTS

| | | | |
|---|---|---|---|
| EP | 1017729 | A2 | 7/2000 |
| EP | 1233191 | A2 | 8/2002 |
| EP | 1614699 | A1 | 1/2006 |
| WO | 1991/09882 | A1 | 7/1991 |
| WO | 1993/014132 | A1 | 7/1993 |
| WO | 1994/003506 | A1 | 2/1994 |
| WO | 1995/007941 | A1 | 3/1995 |
| WO | 1999/052950 | A1 | 10/1999 |
| WO | 2000/024792 | A1 | 5/2000 |
| WO | 2000/024793 | A1 | 5/2000 |
| WO | 2001/058912 | A1 | 8/2001 |
| WO | 2002/036651 | A1 | 5/2002 |
| WO | 2003/040095 | A2 | 5/2003 |
| WO | 2003/040201 | A1 | 5/2003 |
| WO | 2003/040202 | A2 | 5/2003 |
| WO | 2003/040233 | A2 | 5/2003 |
| WO | 2003/040442 | A1 | 5/2003 |
| WO | 2005/049672 | A1 | 6/2005 |

OTHER PUBLICATIONS

Rudnick et al., "Synthetic Lubricants and High-Performance Functional Fluids, Revised and Expanded", 1999, pp. 357-392.
Subramaniam, "Rubber Technology", 1995, pp. 179-208.
Ver et al., "Near Monodisperse Ethylene-Propylene Copolymers by Direct Ziegler-Natta Polymerization. Preparation, Characterization, Properties", Macromolecules, vol. 21, Issue 12, 1988, pp. 3360-3371.

* cited by examiner

*Primary Examiner* — Lynda Salvatore
(74) *Attorney, Agent, or Firm* — Bridget C. Sciamanna; Kathleen A. Tyrrell

(57) ABSTRACT

An article comprising a yarn comprising an elastomeric propylene-based polymer composition; said polymer composition comprising at least one elastomeric propylene-based polymer, wherein said yarn has a draft greater than 200%; wherein said article is a fabric or a garment.

5 Claims, No Drawings

FABRIC INCLUDING POLYOLEFIN ELASTIC FIBER

CROSS-REFERENCE TO RELATED APPLICATION

This is application is a Divisional of U.S. application Ser. No. 12/969,701 filed Dec. 16, 2010, now abandoned.

FIELD OF THE DISCLOSURE

The disclosure relates to elastomeric fibers, specifically polyolefin elastic fibers having a break elongation making them suitable for apparel fabrics having elasticity.

BACKGROUND

Elastic and elastomeric fibers and yarns are known. Examples include spandex and rubber. However, these typical elastic yarns suffer from many disadvantages. Natural rubber has limitations such as availability only heavy deniers and limited suitability for apparel due to potential for latex allergy.

Spandex yarns have excellent stretch and recovery, but are costly to manufacture. Also, spandex is vulnerable to chemical and environmental conditions such as exposure to chlorine, nitrogen oxides ($NO_x$, where x is 1 or 2), fumes, UV, and ozone among others.

Currently available polyolefin elastomers have low elongation/stretch, very low recovery power and high set (growth) making them unsuitable for typical apparel stretch fabric applications.

U.S. Patent Application Publication 2009/0298964 discloses a polyolefin composition that is spun into a yarn, but these yarns are unsuitable for apparel fabrics due to limited elongation, reaching a maximum of 195%.

SUMMARY

The elastomeric yarns, filaments, and fibers in some aspects can be made from a composition including a blend of one or more elastomeric propylene-based polymers, one or more antioxidants, and one or more crosslinking agents (also referred to as coagents).

An embodiment of the present disclosure includes an article, such as a fabric or a garment, including a yarn including an elastomeric propylene-based polymer composition. The polymer composition includes at least one elastomeric propylene-based polymer, wherein the yarn has a draft of greater than 200% or greater than about 200%.

Also disclosed is a method for preparing a fabric including an elastomeric propylene-based polymer yarn including:

(a) providing an elastomeric propylene-based polymer composition;

(b) heating the elastomeric propylene-based polymer composition to a temperature of about 220° C. to about 300° C.;

(c) extruding the composition through a capillary to form a yarn;

(d) optionally winding said yarn onto a package; and (e) preparing a fabric including said yarn.

Another embodiment provides for a method for preparing fabric including an elastomeric propylene-based polymer yarn including:

(a) providing an elastomeric propylene-based polymer composition;

(b) heating the elastomeric propylene-based polymer composition to a temperature of about 220° C. to about 300° C.;

(c) extruding the composition through a capillary to form a yarn;

(d) optionally winding the yarn onto a package;

(e) preparing a warp comprising a plurality of the yarns;

(f) exposing the yarns to an ebeam to crosslink the yarns;

(g) taking up the yarn on a beam; and (h) warp knitting a fabric.

DETAILED DESCRIPTION

Before the present disclosure is described in greater detail, it is to be understood that this disclosure is not limited to particular embodiments described, as such may, of course, vary. It is also to be understood that the terminology used herein is for the purpose of describing particular embodiments only, and is not intended to be limiting, since the scope of the present disclosure will be limited only by the appended claims.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features that may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of chemistry, fiber technology, textiles, and the like, which are within the skill of the art. Such techniques are fully explained in the literature.

The following examples are put forth so as to provide those of ordinary skill in the art with a complete disclosure and description of how to perform the methods and use the compositions and compounds disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is in atmospheres. Standard temperature and pressure are defined as 25° C. and 1 atmosphere.

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

Definitions

As used herein, the term "fiber" refers to filamentous material that can be used in fabric and yarn as well as textile fabrication. One or more fibers or filaments can be used to produce a yarn. The yarn can be fully drawn or textured according to methods known in the art. The terms "yarn," "fiber," and "filament" will be used interchangeably as the yarn may include a single fiber or filament or a combination of fibers or filaments. In embodiments, the stretch yarn is made from an elastomeric propylene-based polymer fiber.

As used herein, the term "elongation" refers to a fiber or yarn in a stretched orientation. This is described as a percentage which is the ration of the stretched length to the original length. "Break elongation" is the elongation at which the yarn breaks.

Elastomeric Propylene-Based Polymer

The terms "elastomeric propylene-based polymer," "propylene-based polymer," and "propylene polymer" will be used interchangeably and include one or more elastomeric propylene-based polymers, one or more propylene-α-olefin copolymers, one or more propylene-α-olefin-diene terpolymers, and one or more propylene-diene copolymers. Blends of two or more of these polymers, copolymers and/or terpolymers are also included.

The term "elastomeric propylene-based polymer composition" refers to a composition including at least one elastomeric propylene-based polymer along with any additives which can be used to provide a melt spun filament or yarn.

The propylene-based polymer can be prepared by polymerizing propylene with one or more dienes. In at least one other specific embodiment, the propylene-based polymer can be prepared by polymerizing propylene with ethylene and/or at least one $C_4$-$C_{20}$ α-olefin, or a combination of ethylene and at least one $C_4$-$C_{20}$ α-olefin and one or more dienes. The one or more dienes can be conjugated or non-conjugated. Preferably, the one or more dienes are non-conjugated.

The comonomers can be linear or branched. Linear comonomers include ethylene or $C_4$-$C_8$ α-olefin, such as ethylene, 1-butene, 1-hexene, and 1-octene. Branched comonomers include 4-methyl-1-pentene, 3-methyl-1-pentene, and 3,5,5-trimethyl-1-hexene. In one or more embodiments, the comonomer can include styrene.

Illustrative dienes can include, but are not limited to, 5-ethylidene-2-norborene (ENB); 1,4-hexadiene; 5-methylene-2-norborene (MNB); 1,6-octadiene; 5-methyl-1,4-hexadiene; 3,7-dimethyl-1,6-octadiene; 1,3-cyclopentadiene; 1,4-cyclohexadiene; vinyl norbornene (VNB); dicyclopendadiene (DCPD), and combinations thereof.

Suitable methods and catalysts for producing the propylene-based polymers are found in publications US 2004/0236042 and WO05/049672 and in U.S. Pat. No. 6,881,800, which are all incorporated by reference herein. Pyridine amine complexes, such as those described in WO03/040201 are also useful to produce the propylene-based polymers useful herein, which is incorporated herein by reference. The catalyst can involve a fluxional complex, which undergoes periodic intra-molecular re-arrangement so as to provide the desired interruption of stereo regularity as in U.S. Pat. No. 6,559,262, which is incorporated herein by reference. The catalyst can be a stereorigid complex with mixed influence on propylene insertion, see Rieger EP1070087, which is incorporated herein by reference. The catalyst described in EP1614699 could also be used for the production of backbones suitable for the some embodiments of the present disclosure, which is incorporated herein by reference.

Polymerization methods for preparing the elastomeric propylene-based polymers include high pressure, slurry, gas, bulk, solution phase, and combinations thereof. Catalyst systems that can be used include traditional Ziegler-Natta catalysts and single-site metallocene catalyst systems. The catalyst used may have a high isospecificity. Polymerization may be carried out by a continuous or batch process and may include the use of chain transfer agents, scavengers, or other such additives well known to those skilled in the art. The polymers may also contain additives such as flow improvers, nucleators, and antioxidants which are normally added to improve or retain resin and/or yarn properties.

One suitable catalyst is a bulky ligand transition metal catalyst. The bulky ligand contains a multiplicity of bonded atoms, for example, carbon atoms, forming a group, which may be cyclic with one or more optional hetero-atoms. The bulky ligand may be metallocene-type cyclopentadienyl derivative, which can be mono- or poly-nuclear. One or more bulky ligands may be bonded to the transition metal atom. The bulky ligand is assumed, according to prevailing scientific theory, to remain in position in the course of polymerization to provide a homogenous polymerization effect. Other ligands may be bonded or coordinated to the transition metal, optionally detachable by a cocatalyst or activator, such as a hydrocarbyl or halogen-leaving group. It is assumed that detachment of any such ligand leads to the creation of a coordination site at which the olefin monomer can be inserted into the polymer chain. The transition metal atom is a Group IV, V, or VI transition metal of the Periodic Table of Elements. One suitable transition metal atom is a Group IVB atom.

Suitable catalysts include single sited catalysts (SSC). These generally contain a transition metal of Groups 3 to 10 of the Periodic Table; and at least one ancillary ligand that remains bonded to the transition metal during polymerization. The transition metal may be used in a cationic state and stabilized by a cocatalyst or activator. Examples include metallocenes of Group 4 of the Periodic table such as titanium, hafnium, or zirconium which are used in polymerization in the $d^0$ mono-valent cationic state and have one or two ancillary ligands as described in more detail hereafter. Some features of such catalysts for coordinating polymerization include a ligand capable of abstraction and a ligand into which the ethylene (olefinic) group can be inserted.

The metallocene can be used with a cocatalyst that may be alumoxane such as methylalumoxane having an average degree of oligomerization of 4 to 30 as determined by vapor pressure osmometry. Alumoxane may be modified to provide solubility in linear alkanes or be used in a slurry but is generally used from a toluene solution. Such solutions may include unreacted trialkyl aluminum and the alumoxane concentration is generally indicated as mol Al per liter, which figure includes any trialkyl aluminum which has not so reacted to form an oligomer. The alumoxane, when used as cocatalyst, is generally used in molar excess, at a mol ratio of about 50 or more, including about 100 or more, about 1000 or less, and about 500 or less, relative to the transition metal.

The SSC may be selected from among a broad range, of available SSC's, to suit the type of polymer being made and the process window associated therewith in such a way that the polymer is produced under the process conditions at an activity of at least about 40,000 gram polymer per gram SSC (such as a metallocene), such as at least about 60,000 including in excess of about 100,000 gram polymer per gram SSC. By enabling the different polymers to be produced in different operating windows with an optimized catalyst selection, the SSC and any ancillary catalyst components can be used in small quantities, with optionally also using small amounts of scavengers. A catalyst killer can be used in equally small amounts and the various cost-effective methods can then be introduced to allow the non-polar solvent to be recycled and subjected to treatment to remove polar contaminants before re-use in the polymerization reactor(s).

The metallocene may be also be used with a cocatalyst which is a non- or weakly coordinated anion (the term non-coordinating anion as used herein includes weakly coordinated anions). The coordination should be sufficiently weak in any event, as evidenced by the progress of polymerization, to permit the insertion of the unsaturated monomer component. The non-coordinating anion may be supplied and reacted with the metallocene in any of the manners described in the art.

The precursor for the non-coordinating anion may be used with a metallocene supplied in a reduced valency state. The precursor may undergo a redox reaction. The precursor may be an ion pair of which the precursor cation is neutralized and/or eliminated in some manner. The precursor cation may be an ammonium salt. The precursor cation may be a triphenylcarbonium derivative.

The non-coordinating anion can be a halogenated, tetraaryl-substituted Group 10-14 non-carbon element-based anion, especially those that are have fluorine groups substituted for hydrogen atoms on the aryl groups, or on alkyl substituents on those aryl groups.

Effective Group 10-14 element cocatalyst complexes may be derived from an ionic salt including a 4-coordinate Group 10-14 element anionic complex, where $A^-$ can be represented as $$[(M)Q_1\ Q_2 \ldots Q_i]^-$$

where M is one or more Group 10-14 metalloid or metal, such as boron or aluminum, and each Q is a ligand effective for providing electronic or steric effects rendering $[(M')\ Q_1\ Q_2 \ldots Q_i]^-$ suitable as a non-coordinating anion as that is understood in the art, or a sufficient number of Q are such that $[(M')\ Q_1\ Q_2 \ldots Q\ Q_i]^-$ as a whole is an effective non-coordinating or weakly coordinating anion. Exemplary Q substituents specifically include fluorinated aryl groups, such as perfluorinated aryl groups, and include substituted Q groups having substituents additional to the fluorine substitution, such as fluorinated hydrocarbyl groups. Exemplary fluorinated aryl groups include phenyl, biphenyl, naphthyl and derivatives thereof.

The non-coordinating anion may be used in approximately equimolar amounts relative to the transition metal component, such as at least about 0.25, including about 0.5 and about 0.8 and no more than about 4, or about 2 or about 1.5.

Representative metallocene compounds can have the formula:

$$L^A L^B L^C{}_i MDE$$

where, $L^A$ is a substituted cyclopentadienyl or heterocyclopentadienyl ancillary ligand π-bonded to M; $L^B$ is a member of the class of ancillary ligands defined for $L^A$, or is J, a hetero-atom ancillary ligand σ-bonded to M; the $L^A$ and $L^B$ ligands may be covalently bridged together through a Group 14 element linking group; $L^C{}_i$ is an optional neutral, non-oxidizing ligand having a dative bond to M (i equals 0 to 3); M is a Group 4 or 5 transition metal; and, D and E are independently mono-anionic labile ligands, each having a a-bond to M, optionally bridged to each other or $L^A$ or $L^B$. The mono-anionic ligands are displaceable by a suitable activator to permit insertion of a polymerizable monomer or macro-monomer can insert for coordination polymerization on the vacant coordination site of the transition metal component.

Representative non-metallocene transition metal compounds usable as SSC's also include tetrabenzyl zirconium, tetra bis(trimethylsiylmethyl) zirconium, oxotris(trimethlsilylmethyl) vanadium, tetrabenzyl hafnium, tetrabenzyl titanium, bis(hexamethyl disilazido)dimethyl titanium, tris(trimethyl silyl methyl) niobium dichloride, and tris (trimethylsilylmethyl) tantalum dichloride.

Additional organometallic transition metal compounds suitable as olefin polymerization catalysts in accordance with the present disclosure will be any of those Group 3-10 that can be converted by ligand abstraction into a catalytically active cation and stabilized in that active electronic state by a non-coordinating or weakly coordinating anion sufficiently labile to be displaced by an olefinically unsaturated monomer such as ethylene.

Other useful catalysts include metallocenes which are biscyclopentadienyl derivatives of a Group IV transition metal, such as zirconium or hafnium. These may be derivatives containing a fluorenyl ligand and a cyclopentadienyl ligand connected by a single carbon and silicon atom. The Cp ring may be unsubstituted and/or the bridge contains alkyl substituents, suitably alkylsilyl substituents to assist in the alkane solubility of the metallocene such as those disclosed in PCT published applications WO00/24792 and WO00/24793, each of which are incorporated herein by reference. Other possible metallocenes include those in PCT published application WO01/58912, which is included herein by reference.

Other suitable metallocenes may be bisfluorenyl derivatives or unbridged indenyl derivatives which may be substituted at one or more positions on the fused ring with moieties which have the effect of increasing the molecular weight and so indirectly permit polymerization at higher temperatures.

The total catalyst system may additionally include one or more organometallic compounds as scavenger. Such compounds are meant to include those compounds effective for removing polar impurities from the reaction environment and for increasing catalyst activity. Impurities can be inadvertently introduced with any of the polymerization reaction components, particularly with solvent, monomer and catalyst feed, and adversely affect catalyst activity and stability. It can result in decreasing or even elimination of catalytic activity, particularly when ionizing anion pre-cursors activate the catalyst system. The impurities, or catalyst poisons include water, oxygen, polar organic compounds, metal impurities, etc. Steps can be taken to remove these poisons before introduction of such into the reaction vessel, for example, by chemical treatment or careful separation techniques after or during the synthesis or preparation of the various components, but some minor amounts of organometallic compound will still normally be used in the polymerization process itself.

Typically organometallic compounds can include the Group-13 organometallic compounds disclosed in U.S. Pat. Nos. 5,153,157 and 5,241,025 and PCT publications WO91/09882, WO94/03506, WO93/14132, and WO95/07941, each of which is incorporated herein by reference. Suitable compounds include triethyl aluminum, triethyl borane, tri-isobutyl aluminum, tri-n-octyl aluminum, methylalumoxane, and isobutyl alumoxane. Alumoxane also may be used in scavenging amounts with other means of activation, e.g., methylalumoxane and tri-isobutylaluminoxane with boron-based activators. The amount of such compounds to be used with catalyst compounds is minimized during polymerization reactions to that amount effective to enhance activity (and with that amount necessary for activation of the catalyst compounds if used in a dual role) since excess amounts may act as catalyst poisons.

The propylene-based polymer can have an average propylene content on a weight percent basis of about 60 wt % to about 99.7 wt %, including about 60 wt % to about 99.5 wt %, about 60 wt % to about 97 wt % and about 60 wt % to about 95 wt % based on the weight of the polymer. In one aspect, the balance may include one or more other α-olefins or one or more dienes. In other embodiments, the content can be about 80 wt % to about 95 wt % propylene, about 83 wt % to about 95 wt % propylene, about 84 wt % to about 95 wt % propylene, and about 84 wt % to about 94 wt % propylene based on the weight of the polymer. The balance of the propylene-based polymer optionally comprises a diene and/or one or more α-olefins. The α-olefin may include ethylene, butene, hexene or octene. When two α-olefins are present, they may include any combination such as ethylene and one of butene, hexane, or octene. The propylene-based polymer comprises about 0.2 wt % to about 24 wt %, of a non-conjugated diene based on the weight of the polymer, including about 0.5 wt % to about 12 wt %, about 0.6 wt % to about 8 wt %, and about 0.7 wt % to about 5 wt %. In other embodiments, the diene content can be about 0.2 wt % to about 10 wt %, including about 0.2 to about 5 wt %, about 0.2 wt % to about 4 wt %, about 0.2 wt % to about 3.5 wt %, about 0.2 wt % to about 3.0 wt %, and about 0.2 wt % to about 2.5 wt % based on the weight of the polymer. In one or more embodiments above or elsewhere herein, the propylene-based polymer comprises ENB in an amount of about 0.5 to about 4 wt %, including about 0.5 to about 2.5 wt %, and about 0.5 to about 2.0 wt %.

In other embodiments, the propylene-based polymer includes propylene and diene in one or more of the amounts described above with the balance comprising one or more $C_2$ and/or $C_4$-$C_{20}$ α-olefins. In general, this will amount to the propylene-based polymer including about 5 to about 40 wt % of one or more $C_2$ and/or $C_4$-$C_{20}$ α-olefins based the weight of the polymer. When $C_2$ and/or a $C_4$-$C_{20}$ α-olefins are present the combined amounts of these olefins in the polymer may be about 5 wt % or greater and falling within the amounts described herein. Other suitable amounts for the one or more α-olefins include about 5 wt % to about 35 wt %, including about 5 wt % to about 30 wt %, about 5 wt % to about 25 wt %, about 5 wt % to about 20 wt %, about 5 to about 17 wt % and about 5 wt % to about 16 wt %.

The propylene-based polymer can have a weight average molecular weight (Mw) of about 5,000,000 or less, a number average molecular weight (Mn) of about 3,000,000 or less, a z-average molecular weight (Mz) of about 10,000,000 or less, and a g' index of about 0.95 or greater measured at the weight average molecular weight (Mw) of the polymer using isotactic polypropylene as the baseline, all of which can be determined by size exclusion chromatography, e.g., 3D SEC, also referred to as GPC-3D as described herein.

In one or more embodiments above or elsewhere herein, the propylene-based polymer can have a Mw of about 5,000 to about 5,000,000 g/mole, including a Mw of about 10,000 to about 1,000,000, a Mw of about 20,000 to about 500,000 and a Mw of about 50,000 to about 400,000, wherein Mw is determined as described herein.

In one or more embodiments above or elsewhere herein, the propylene-based polymer can have a Mn of about 2,500 to about 2,500,000 g/mole, including a Mn of about 5,000 to about 500,000, a Mn of about 10,000 to about 250,000, and a Mn of about 25,000 to about 200,000, wherein Mn is determined as described herein.

In one or more embodiments above or elsewhere herein, the propylene-based polymer can have a Mz of about 10,000 to about 7,000,000 g/mole, including a Mz of about 50,000 to about 1,000,000, a Mz of about 80,000 to about 700,000, and a Mz of about 100,000 to about 500,000, wherein Mz is determined as described herein.

The molecular weight distribution index (MWD=(Mw/Mn)), sometimes referred to as a "polydispersity index" (PDI), of the propylene-based polymer can be about 1.5 to about 40. The MWD can have an upper limit of about 40, or about 20, or about 10, or about 5, or about 4.5, and a lower limit of about 1.5, or about 1.8, or about 2.0. The MWD of the propylene-based polymer may be about 1.8 to about 5 and including about 1.8 to about 3. Techniques for determining the molecular weight (Mn and Mw) and molecular weight distribution (MWD) are well known in the art and can be found in U.S. Pat. No. 4,540,753 (which is incorporated by reference herein for purposes of U.S. practices) and references cited therein, in Macromolecules, 1988, volume 21, p 3360 (Verstrate et al.), and in accordance with the procedures disclosed in U.S. Pat. No. 6,525,157, column 5, lines 1-44, all of which are hereby incorporated by reference in their entirety.

The propylene-based polymer can have a g' index value of about 0.95 or greater, including about 0.98 or greater and about 0.99 or greater wherein g' is measured at the Mw of the polymer using the intrinsic viscosity of isotactic polypropylene as the baseline. For use herein, the g' index is defined as:

$$g'=\eta_b/\eta_l$$

where $\eta_b$ is the intrinsic viscosity of the propylene-based polymer and $\eta_l$ is the intrinsic viscosity of a linear polymer of the same viscosity-averaged molecular weight ($M_v$) as the propylene-based polymer. $\eta_l=KM_v^{\alpha}$, K and α were measured values for linear polymers and should be obtained on the same instrument as the one used for the g' index measurement.

The propylene-based polymer can have a density of about 0.85 g/cm$^3$ to about 0.92 g/cm$^3$, including about 0.87 g/cm$^3$ to 0.90 g/cm$^3$ and about 0.88 g/cm$^3$ to about 0.89 g/cm$^3$ at about room temperature as measured per the ASTM D-1505 test method.

The propylene-based polymer can have a melt flow rate MFR, of about 2.16 kg weight (230° C.), equal to or greater than 0.2 g/10 min as measured according to the ASTM D-1238(A) test method as modified (described below). The MFR (about 2.16 kg (230° C.) may be about 0.5 g/10 min to about 200 g/10 min including about 1 g/10 min to about 100 g/10 min. The propylene-based polymer may have an MFR of about 0.5 g/10 min to about 200 g/10 min, including about 2 g/10 min to about 30 g/10 min, about 5 g/10 min to about 30 g/10 min, about 10 g/10 min to about 30 g/10 min, about 10 g/10 min to about 25 g/10 min, and about 2 g/10 min to about 10 g/10 min.

The propylene-based polymer can have a Mooney viscosity ML (1+4) 125° C., as determined according to ASTM D1646, of less than about 100, such as less than about 75, including less than about 60 and less than about 30.

The propylene-based polymer can have a heat of fusion (Hf) determined according to the DSC procedure described later, which is greater than or equal to about 0.5 Joules per gram (J/g), and can be about 80 J/g, including about 75 J/g, about 70 J/g, about 60 J/g, about 50 J/g, and about 35 J/g. The propylene-based polymer may have a heat of fusion that is greater than or equal to about 1 J/g, including greater than or equal to about 5 J/g. In another embodiment, the propylene-based polymer can have a heat of fusion (Hf), which is about 0.5 J/g to about 75 J/g, including about 1 J/g to about 75 J/g and about 0.5 J/g to about 35 J/g.

Suitable propylene-based polymers and compositions can be characterized in terms of both their melting points (Tm) and heats of fusion, which properties can be influenced by the presence of comonomers or steric irregularities that hinder the formation of crystallites by the polymer chains. In one or more embodiments, the heat of fusion can have a lower limit of about 1.0 J/g, or about 1.5 J/g, or about 3.0 J/g, or about 4.0 J/g, or about 6.0 J/g, or about 7.0 J/g, to an upper limit of about 30 J/g, or about 35 J/g, or about 40 J/g, or about 50 J/g, or about 60 J/g or about 70 J/g, or about 75 J/g, or about 80 J/g.

The crystallinity of the propylene-based polymer can also be expressed in terms of percentage of crystallinity (i.e. % crystallinity). In one or more embodiments above or elsewhere herein, the propylene-based polymer has a % crystallinity of about 0.5% to 40%, including about 1% to 30% and about 5% to 25% wherein % crystallinity is determined according to the DSC procedure described below. In another embodiment, the propylene-based polymer may have a crystallinity of less than about 40%, including about 0.25% to about 25%, about 0.5% to about 22%, and about 0.5% to about 20%. As disclosed above, the thermal energy for the highest order of polypropylene is estimated at about 189 J/g (i.e., 100% crystallinity is equal to 209 J/g.).

In addition to this level of crystallinity, the propylene-based polymer may have a single broad melting transition. Also, the propylene-based polymer can show secondary melting peaks adjacent to the principal peak, but for purposes herein, such secondary melting peaks are considered together as a single melting point, with the highest of these peaks (relative to baseline as described herein) being considered the melting point of the propylene-based polymer.

The propylene-based polymer may have a melting point (measured by DSC) of equal to or less than about 100° C., including less than about 90° C., less than about 80° C., and less than or equal to about 75° C., including the range from about 25° C., to about 80° C., about 25° C., to about 75° C., and about 30° C., to about 65° C.

The Differential Scanning calorimetry (DSC) procedure can be used to determine heat of fusion and melting temperature of the propylene-based polymer. The method is as follows: about 0.5 grams of polymer is weighed out and pressed to a thickness of about 15-20 mils (about 381-508 microns) at about 140° C.-150° C., using a "DSC mold" and Mylar as a backing sheet. The pressed pad is allowed to cool to ambient temperature by hanging in air (the Mylar is not removed). The pressed pad is annealed at room temperature (about 23-25° C.) for about 8 days. At the end of this period, an about 15-20 mg disc is removed from the pressed pad using a punch die and is placed in a 10 microliter aluminum sample pan. The sample is placed in a Differential Scanning calorimeter (Perkin Elmer Pyris 1 Thermal Analysis System) and is cooled to about −100° C. The sample is heated at about 10° C./min to attain a final temperature of about 165° C. The thermal output, recorded as the area under the melting peak of the sample, is a measure of the heat of fusion and can be expressed in Joules per gram of polymer and is automatically calculated by the Perkin Elmer System. The melting point is recorded as the temperature of the greatest heat absorption within the range of melting of the sample relative to a baseline measurement for the increasing heat capacity of the polymer as a function of temperature.

The propylene-based polymer can have a triad tacticity of three propylene units, as measured by 13C NMR of about 75% or greater, about 80% or greater, about 82% or greater, about 85% or greater, or about 90% or greater. In an embodiment, the triad tacticity can be about 50 to about 99%, about 60 to about 99%, about 75 to about 99% about 80 to about 99%; and in other embodiments about 60 to about 97%. Triad tacticity is well-known in the art and may be determined by the methods described in U.S. Patent Application Publication No. 2004/0236042, which is incorporated herein by reference.

The elastomeric propylene-based polymer can include a blend of two propylene-based polymers differing in the olefin content, the diene content, or both.

In one or more embodiments above or elsewhere herein, the propylene-based polymer can include a propylene based elastomeric polymer produced by random polymerization processes leading to polymers having randomly distributed irregularities in stereoregular propylene propagation. This is in contrast to block copolymers in which constituent parts of the same polymer chains are separately and sequentially polymerized.

The propylene-based polymers can also include copolymers prepared according the procedures in WO 02/36651, which is incorporated herein by reference. Likewise, the propylene-based polymer can include polymers consistent with those described in WO 03/040201, WO 03/040202, WO 03/040095, WO 03/040201, WO 03/040233, and/or WO 03/040442, each of which are incorporated herein by reference. Additionally, the propylene-based polymer can include polymers consistent with those described in EP 1 233 191, and U.S. Pat. No. 6,525,157, along with suitable propylene homo- and copolymers described in U.S. Pat. No. 6,770,713 and U.S. Patent Application Publication 2005/215964, all of which are incorporated by reference. The propylene-based polymer can also include one or more polymers consistent with those described in EP 1 614 699 or EP 1 017 729, each of which are incorporated herein by reference.

Grafted (Functionalized) Backbone

In one or more embodiments, the propylene-based polymer can be grafted (i.e. "functionalized") using one or more grafting monomers. As used herein, the term "grafting" denotes covalent bonding of the grafting monomer to a polymer chain of the propylene-based polymer.

The grafting monomer can be or include at least one ethylenically unsaturated carboxylic acid or acid derivative, such as an acid anhydride, ester, salt, amide, imide, and acrylates, among others. Illustrative monomers include, but are not limited to, acrylic acid, methacrylic acid, maleic acid, fumaric acid, itaconic acid, citraconic acid, mesaconic acid, maleic anhydride, 4-methyl cyclohexene-1,2-dicarboxylic acid anhydride, bicyclo(2,2,2)octene-2,3-dicarboxylic acid anhydride, 1,2,3,4,5,8,9,10-octahydronaphthalene-2,3-dicarboxylic acid anhydride, 2-oxa-1,3-diketospiro(4,4)nonene, bicycle (2,2,1)heptene-2,3-dicarboxylic acid anhydride, maleopimaric acid, tetrahydrophthalic anhydride, norborene-2,3-dicarboxylic acid anhydride, nadic anhydride, methyl nadic anhydride, himic anhydride, methyl himic anhydride, and 5-methylbicyclo(2,2,1)heptene-2,3-dicarboxylic acid anhydride. Other suitable grafting monomers include methyl acrylate and higher alkyl acrylates, methyl methacrylate and higher alkyl methacrylates, acrylic acid, methacrylic acid, hydroxy-methyl methacrylate, hydroxyl-ethyl methacrylate and higher hydroxy-alkyl methacrylates and glycidyl methacrylate. Maleic anhydride is a preferred grafting monomer.

In one or more embodiments, the grafted propylene based polymer comprises about 0.5 to about 10 wt % ethylenically unsaturated carboxylic acid or acid derivative, including about 0.5 to about 6 wt %, about 0.5 to about 3 wt %; in other embodiments about 1 to about 6 wt %, and about 1 to about 3 wt %. Where the graft monomer is maleic anhydride, the maleic anhydride concentration in the grafted polymer may be about 1 to about 6 wt. %, including about 0.5 wt. % or about 1.5 wt. % as a minimum.

Styrene and derivatives thereof such as paramethyl styrene, or other higher alkyl substituted styrenes such as t-butyl styrene can be used as a charge transfer agent in presence of the grafting monomer to inhibit chain scissioning. This allows further minimization of the beta scission reaction and the production of a higher molecular weight grafted polymer (MFR=1.5).

Preparing Grafted Propylene-Based Polymers

A grafted propylene-based polymer can be prepared using conventional techniques. For example, the graft polymer can be prepared in solution, in a fluidized bed reactor, or by melt grafting. A grafted polymer can be prepared by melt blending in a shear-imparting reactor, such as an extruder reactor. Single screw or twin screw extruder reactors such as co-rotating intermeshing extruder or counter-rotating non-intermeshing extruders but also co-kneaders such as those sold by Buss are useful for this purpose.

The grafted polymer can be prepared by melt blending an ungrafted propylene-based polymer with a free radical generating catalyst, such as a peroxide initiator, in the presence of a grafting monomer. One suitable sequence for the grafting reaction includes melting the propylene-based polymer, adding and dispersing the grafting monomer, introducing peroxide and venting the unreacted monomer and by-products resulting from the peroxide decomposition. Other sequences can include feeding the monomers and the peroxide pre-dissolved in a solvent.

Illustrative peroxide initiators include, but are not limited to: diacyl peroxides such as benzoyl peroxide; peroxyesters such as tert-butylperoxy benzoate, tert-butylperoxy acetate, O,O-tert-butyl-O-(2-ethylhexyl)monoperoxy carbonate; peroxyketals such as n-butyl-4,4-di-(tert-butyl peroxy) valerate; and dialkyl peroxides such as 1,1-bis(tertbutylperoxy) cyclohexane, 1,1-bis(tert-butylperoxy)-3,3,5-trimethylcyclohexane, 2,2-bis(tert-butylperoxy)butane, dicumylperoxide, tert-butylcumylperoxide, Di-(2-tert-butylperoxyisopropyl-(2))benzene, di-tert-butylperoxide (DTBP), 2,5-dimethyl-2,5-di(tert-butylperoxy)hexane, 2,5-dimethyl-2,5-di(tert-butylperoxy)hexyne, 3,3,5,7,7-pentamethyl 1,2,4-trioxepane; among others and combinations thereof.

Polyolefinic Thermoplastic Resin

The term "polyolefinic thermoplastic resin" as used herein refers to any material that is not a "rubber" and that is a polymer or polymer blend having a melting point of 70° C. or more and considered by persons skilled in the art as being thermoplastic in nature, e.g., a polymer that softens when exposed to heat and returns to its original condition when cooled to room temperature. The polyolefinic thermoplastic resin can contain one or more polyolefins, including polyolefin homopolymers and polyolefin copolymers. Except as stated otherwise, the term "copolymer" means a polymer derived from two or more monomers (including terpolymers, tetrapolymers, etc.), and the term "polymer" refers to any carbon-containing compound having repeat units from one or more different monomers.

Illustrative polyolefins can be prepared from monoolefin monomers including, but are not limited to, monomers having 2 to 7 carbon atoms, such as ethylene, propylene, 1-butene, isobutylene, 1-pentene, 1-hexene, 1-octene, 3-methyl-1-pentene, 4-methyl-1-pentene, 5-methyl-1-hexene, mixtures thereof and copolymers thereof with (meth) acrylates and/or vinyl acetates. The polyolefinic thermoplastic resin component is unvulcanized or non-crosslinked.

The polyolefinic thermoplastic resin may contain polypropylene. The term "polypropylene" as used herein broadly means any polymer that is considered a "polypropylene" by persons skilled in the art and includes homo, impact, and random polymers of propylene. The polypropylene used in the compositions described herein has a melting point above about 110° C., includes at least about 90 wt % propylene units, and contains isotactic sequences of those units. The polypropylene can also include atactic sequences or s syndiotactic sequences, or both. The polypropylene can also include essentially syndiotactic sequences such that the melting point of the polypropylene is above about 110° C. The polypropylene can either derive exclusively from propylene monomers (i.e., having only propylene units) or derive from mainly propylene (more than 80% propylene) with the remainder derived from olefins, such as ethylene, and/or $C_4$-$C_{10}$ α-olefins. Certain polypropylenes have a high MFR (e.g., having a low of about 10, or about 15, or about 20 g/10 min to a high of about 25 or about 30 g/10 min.). Others have a lower MFR, e.g., "fractional" polypropylenes which have an MFR less than about 1.0. Those with high MFR can be useful for ease of processing or compounding.

A polyolefinic thermoplastic resin may be or include isotactic polypropylene. The polyolefinic thermoplastic resin may contain one or more crystalline propylene homopolymers or copolymers of propylene having a melting temperature greater than about 105° C. as measured by DSC. Exemplary copolymers of propylene include, but are not limited to, terpolymers of propylene, impact copolymers of propylene, random polypropylene and mixtures thereof. The comonomers may have 2 carbon atoms, or from 4 to 12 carbon atoms, such as ethylene. Such polyolefinic thermoplastic resin and methods for making the same are described in U.S. Pat. No. 6,342,565, which is incorporated herein by reference.

The term "random polypropylene" as used herein broadly means a copolymer of propylene having up to about 9 wt %, such as about 2 wt % to 8 wt % of an α-olefin comonomer. An α-olefin comonomer may have 2 carbon atoms, or 4 to 12 carbon atoms.

A random polypropylene may have a 1% secant modulus of about 100 kPsi to about 200 kPsi, as measured according to ASTM D790A. The 1% secant modulus can be about 140 kPsi to 170 kPsi, as measured according to ASTM D790A, including about 140 kPsi to 160 kPsi or a low of about 100, about 110, or about 125 kPsi to a high of about 145, about 160, or about 175 kPsi, as measured according to ASTM D790A.

Random polypropylene can have a density of about 0.85 to about 0.95 g/cm$^3$, as measured by ASTM D79, including a density of about 0.89 g/cm$^3$ to about 0.92 g/cm$^3$, or having a low of about 0.85, about 0.87, or about 0.89 g/cm$^3$ to a high of about 0.90, about 0.91, about 0.92 g/cm$^3$, as measured by ASTM D792.

Additional Elastomeric Component

The elastomeric polypropylene-based polymer composition can optionally include one or more additional elastomeric components. The additional elastomeric component can be or include one or more ethylene-propylene copolymers (EP). The ethylene-propylene polymer (EP) is non-crystalline, e.g., atactic or amorphous, but the EP may be crystalline (including "semi-crystalline"). The crystallinity of the EP may be derived from the ethylene, which can be determined by a number of published methods, procedures and techniques. The crystallinity of the EP can be distinguished from the crystallinity of the propylene-based polymer by removing the EP from the composition and then measuring the crystallinity of the residual propylene-based polymer. Such crystallinity measured is usually calibrated using the crystallinity of polyethylene and related to the comonomer content. The percent crystallinity in such cases is measured as a percentage of polyethylene crystallinity and thus the origin of the crystallinity from ethylene is established.

In one or more embodiments, the EP can include one or more optional polyenes, including particularly a diene; thus, the EP can be an ethylene-propylene-diene (commonly called "EPDM"). The optional polyene is considered to be any hydrocarbon structure having at least two unsaturated bonds wherein at least one of the unsaturated bonds is readily incorporated into a polymer. The second bond may partially take part in polymerization to form long chain branches but preferably provides at least some unsaturated bonds suitable for subsequent curing or vulcanization in post polymerization processes. Examples of EP or EPDM copolymers include V722, V3708P, MDV 91-9, V878 that are commercially available under the trade name VISTALON from ExxonMobil Chemicals. Several commercial EPDM are available from DOW under the trade names Nordel IP and MG grades.). Certain rubber components (e.g., EPDMs, such as VISTALON 3666) include additive oil that is preblended before the rubber component is combined with the thermoplastic. The type of additive oil utilized will be that customarily used in conjunction with a particular rubber component.

Examples of the optional polyenes include, but are not limited to, butadiene, pentadiene, hexadiene (e.g., 1,4-hexadiene), heptadiene (e.g., 1,6-heptadiene), octadiene (e.g., 1,7-octadiene), nonadiene (e.g., 1,8-nonadiene), decadiene (e.g., 1,9-decadiene), undecadiene (e.g., 1,10-undecadiene), dodecadiene (e.g., 1,11-dodecadiene), tridecadiene (e.g., 1,12-tridecadiene), tetradecadiene (e.g., 1,13-tetradecadiene), pentadecadiene, hexadecadiene, heptadecadiene, octadecadiene, nonadecadiene, icosadiene, heneicosadiene, docosadiene, tricosadiene, tetracosadiene, pentacosadiene, hexacosadiene, heptacosadiene, octacosadiene, nonacosadiene, triacontadiene, and polybutadienes having a molecular weight (Mw) of less than about 1000 g/mol. Examples of straight chain acyclic dienes include, but are not limited to 1,4-hexadiene and 1,6-octadiene. Examples of branched chain acyclic dienes include, but are not limited to 5-methyl-1,4-hexadiene, 3,7-dimethyl-1,6-octadiene, and 3,7-dimethyl-1,7-octadiene. Examples of single ring alicyclic dienes include, but are not limited to 1,4-cyclohexadiene, 1,5-cyclooctadiene, and 1,7-cyclododecadiene. Examples of multi-ring alicyclic fused and bridged ring dienes include, but are not limited to, tetrahydroindene; norbornadiene; methyltetrahydroindene; dicyclopentadiene; bicyclo(2,2,1) hepta-2,5-diene, and alkenyl-, alkylidene-, cycloalkenyl-, and cylcoalkyliene norbornenes [including, e.g., 5-methylene-2-norbornene, 5-ethylidene-2-norbornene, 5-propenyl-2-norbornene, 5-isopropylidene-2-norbornene, 5-(4-cyclopentenyl)-2-norbornene, 5-cyclohexylidene-2-norbornene, and 5-vinyl-2-norbornene]. Examples of cycloalkenyl-substituted alkenes include, but are not limited to, vinyl cyclohexene, allyl cyclohexene, vinylcyclooctene, 4-vinylcyclohexene, allyl cyclodecene, vinylcyclododecene, and tetracyclododecadiene.

In another embodiment, the additional elastomeric component can include, but is not limited to, styrene/butadiene rubber (SBR), styrene/isoprene rubber (SIR), styrene/isoprene/butadiene rubber (SIBR), styrene-butadiene-styrene block copolymer (SBS), hydrogenated styrenebutadiene-styrene block copolymer (SEBS), hydrogenated styrene-butadiene block copolymer (SEB), styrene-isoprenestyrene block copolymer (SIS), styrene-isoprene block copolymer (SI), hydrogenated styrene-isoprene block copolymer (SEP), hydrogenated styrene-isoprene-styrene block copolymer (SEPS), styrene-ethylene/butylene-ethylene block copolymer (SEBE), styrene-ethylene-styrene block copolymer (SES), ethylene-ethylene/butylene block copolymer (EEB), ethylene-ethylene/butylene/styrene block copolymer (hydrogenated BR-SBR block copolymer), styrene-ethylene/butylene-ethylene block copolymer (SEBE), ethylene-ethylene/butylene-ethylene block copolymer (EEBE), polyisoprene rubber, polybutadiene rubber, isoprene butadiene rubber (IBR), polysulfide, nitrile rubber, propylene oxide polymers, star-branched butyl rubber and halogenated star-branched butyl rubber, brominated butyl rubber, chlorinated butyl rubber, star-branched polyisobutylene rubber, star-branched brominated butyl(polyisobutylene/isoprene copolymer) rubber; poly(isobutylene-co-alkylstyrene), suitable isobutylene/methylstyrene copolymers such as isobutylene/meta-bromomethylstyrene, isobutylene/bromomethylstyrene, isobutylene/chloromethylstyrene, halogenated isobutylene cyclopentadiene, and isobutylene/chloromethylstyrene and mixtures thereof. The additional elastomeric components include hydrogenated styrene-butadienestyrene block copolymer (SEBS), and hydrogenated styreneisoprene-styrene block copolymer (SEPS).

The additional elastomeric component can also be or include natural rubber. Natural rubbers are described in detail by Subramaniam in RUBBER TECHNOLOGY 179-208 (1995). Suitable natural rubbers can be selected from the group consisting of Malaysian rubber such as SMR CV, SMR 5, SMR 10, SMR 20, and SMR 50 and mixtures thereof, wherein the natural rubbers have a Mooney viscosity at about 100° C. (ML 1+4) of about 30 to 120, including from about 40 to 65. The Mooney viscosity test referred to herein is in accordance with ASTM D-1646.

The additional elastomeric component can also be or include one or more synthetic rubbers. Suitable commercially available synthetic rubbers include NATSYN™ (Goodyear Chemical Company), and BUDENE™ 1207 or BR 1207 (Goodyear Chemical Company). A suitable rubber is high cis-polybutadiene (cis-BR). By "cis-polybutadiene" or "high cis-polybutadiene", it is meant that 1,4-cis polybutadiene is used, wherein the amount of cis component is at least about 95%. An example of high cis-polybutadiene commercial products used in the composition BUDENE™ 1207.

The additional elastomeric component can be present up to about 50 phr, up to about 40 phr or up to about 30 phr. In one or more embodiments, the amount of the additional rubber component can have a low of about 1, about 7, or about 20 phr to a high of about 25, about 35, or about 50 phr.

Additive Oil

The elastomeric composition can optionally include one or more additive oils. The term "additive oil" includes both "process oils" and "extender oils." For example, "additive oil" may include hydrocarbon oils and plasticizers, such as organic esters and synthetic plasticizers. Many additive oils are derived from petroleum fractions, and have particular ASTM designations depending on whether they fall into the class of paraffinic, naphthenic, or aromatic oils. Other types of additive oils include mineral oil, alpha olefinic synthetic oils, such as liquid polybutylene, e.g., products sold under the trademark Parapol®. Additive oils other than petroleum based oils can also be used, such as oils derived from coal tar and pine tar, as well as synthetic oils, e.g., polyolefin materials (e.g., SpectaSyn™ and Elevast™, both supplied by ExxonMobil Chemical Company.

It is well-known in the art which type of oil should be used with a particular rubber, as well as suitable amounts (quantity) of oil. The additive oil can be present in amounts of about 5 to about 300 parts by weight per 100 parts by weight of the blend of the rubber and thermoplastic components. The amount of additive oil may also be expressed as about 30 to 250 parts or about 70 to 200 parts by weight per 100 parts by weight of the rubber component. Alternatively, the quantity of additive oil can be based on the total rubber content, and defined as the ratio, by weight, of additive oil to total rubber and that amount may in certain cases be the combined amount of process oil and extender oil. The ratio may range, for example, about 0 to about 4.0/1. Other ranges, having any of the following lower and upper limits, may also be utilized: a lower limit of about 0.1/1, or about 0.6/1, or about 0.8/1, or about 1.0/1, or about 1.2/1, or about 1.5/1, or about 1.8/1, or about 2.0/1, or about 2.5/1; and an upper limit (which may be combined with any of the foregoing lower limits) of about 4.0/1, or about 3.8/1, or about 3.5/1, or about 3.2/1, or about 3.0/1, or about 2.8/1. Larger amounts of additive oil can be used, although the deficit is often reduced physical strength of the composition, or oil weeping, or both.

Polybutene oils are suitable. Exemplary polybutene oils have an Mn of less than 15,000, and include homopolymer or copolymer of olefin derived units having 3 to 8 carbon atoms and more preferably 4 to 6 carbon atoms. The polybutene may be a homopolymer or copolymer of a $C_4$ raffinate. Exemplary low molecular weight polymers termed "polybutene" polymers is described in, for example, SYNTHETIC LUBRICANTS AND HIGH-PERFORMANCE FUNCTIONAL FLUIDS 357-392 (Leslie R. Rudnick & Ronald L. Shubkin, ed., Marcel Dekker 1999) (hereinafter "polybutene processing oil" or "polybutene").

The polybutene processing oil can be a copolymer having at least isobutylene derived units, and optionally 1-butene derived units, and/or 2-butene derived units. The polybutene can be a homopolymer if isobutylene, or a copolymer of isobutylene and 1-butene or 2-butene, or a terpolymer of isobutylene and 1-butene and 2-butene, wherein the isobutylene derived units are about 40 to 100 wt % of the copolymer, the 1-butene derived units are about 0 to 40 wt % of the copolymer, and the 2-butene derived units are about 0 to 40 wt % of the copolymer. The polybutene can be a copolymer or terpolymer wherein the isobutylene derived units are about 40 to 99 wt % of the copolymer, the 1-butene derived units are about 2 to 40 wt % of the copolymer, and the 2-butene derived units are about 0 to 30 wt % of the copolymer. The polybutene may also be a terpolymer of the three units, wherein the isobutylene derived units are about 40 to 96 wt % of the copolymer, the 1-butene derived units are about 2 to 40 wt % of the copolymer, and the 2-butene derived units are about 2 to 20 wt % of the copolymer. Another suitable polybutene is a homopolymer or copolymer of isobutylene and 1-butene, wherein the isobutylene derived units are about 65 to 100 wt % of the homopolymer or copolymer, and the 1-butene derived units are about 0 to 35 wt % of the copolymer. Commercial examples of a suitable processing oil includes the PARAPOL™ Series of processing oils or polybutene grades or Indopol™ from Soltex Synthetic Oils and Lubricants from BP/Innovene.

The processing oil or oils can be present at about 1 to 60 phr, including about 2 to 40 phr, about 4 to 35 phr and about 5 to 30 phr in yet another embodiment.

Cross-Linking Agents/Co-Agents

The elastomeric propylene-based polymer composition can optionally include one or more cross-linking agents, also referred to as co-agents. Suitable co-agents can include liquid and metallic multifunctional acrylates and methacrylates, functionalized polybutadiene resins, functionalized cyanurate, and allyl isocyanurate. More particularly, suitable coagents can include, but are not limited to, polyfunctional vinyl or allyl compounds such as, for example, triallyl cyanurate, triallyl isocyanurate, pentaerthritol tetramethacrylate, ethylene glycol dimethacrylate, diallyl maleate, dipropargyl maleate, dipropargyl monoallyl cyanurate, azobisisobutyronitrile and the like, and combinations thereof. Commercially available cross-linking agents/co-agents can be purchased from Sartomer.

The elastomeric propylene-based polymer composition may contain about 0.1 wt % or greater of co-agent based on the total weight of polymer composition. The amount of co-agent(s) can be about 0.1 wt % to about 15 wt %, based on the total weight of polymer composition. In one or more embodiments, the amount of co-agent(s) can have a low of about 0.1 wt %, about 1.5 wt % or about 3.0 wt % to a high of about 4.0 wt %, about 7.0 wt %, or about 15 wt %, based on the total weight of blend. In one or more embodiments, the amount of co-agent (s) can have a low of about 2.0 wt %, about 3.0 wt %, or about 5.0 wt % to a high of about 7.0 wt %, about 9.5 wt %, or about 12.5 wt %, based on the total weight of the polymer composition.

Antioxidants

The elastomeric propylene-based polymer composition can optionally include one or more anti-oxidants. Suitable anti-oxidants can include hindered phenols, phosphites, hindered amines, Irgafos 168, Irganox 1010, Irganox 3790, Irganox B225, Irganox 1035, Irgafos 126, Irgastab 410, Chimassorb 944, etc. made by Ciba Geigy Corp. These may be added to the elastomeric composition to protect against degradation during shaping or fabrication operation and/or to better control the extent of chain degradation which can be especially useful where the elastomeric propylene-based polymer composition is exposed to e-beam.

The elastomeric propylene-based composition contains at least about 0.1 wt % of antioxidant, based on the total weight of blend. In one or more embodiments, the amount of antioxidant(s) can be about 0.1 wt % to about 5 wt %, based on the total weight of blend. In one or more embodiments, the amount of antioxidant(s) can have a low of about 0.1 wt %, about 0.2 wt % or about 0.3 wt % to a high of about 1 wt %, about 2.5 wt %, or about 5 wt %, based on the total weight of blend. In one or more embodiments, the amount of antioxidant(s) is about 0.1 wt %, based on the total weight of blend. In one or more embodiments, the amount of antioxidant(s) is about 0.2 wt %, based on the total weight of blend. In one or more embodiments, the amount of antioxidant(s) is about 0.3 wt %, based on the total weight of blend. In one or more embodiments, the amount of antioxidant(s) is about 0.4 wt %, based on the total weight of blend. In one or more embodiments, the amount of antioxidant(s) is about 0.5 wt %, based on the total weight of blend.

Blending and Additives

In one or more embodiments, the individual materials and components, such as the propylene-based polymer and optionally the one or more polyolefinic thermoplastic resins, additional elastomeric component, additive oil, coagents, and anti-oxidants can be blended by melt-mixing to form a blend. Examples of machinery capable of generating the shear and mixing include extruders with kneaders or mixing elements with one or more mixing tips or flights, extruders with one or more screws, extruders of co or counter rotating type, Banbury mixer, Farrell Continuous mixer, and the Buss Kneader. The type and intensity of mixing, temperature, and residence time required can be achieved by the choice of one of the above machines in combination with the selection of kneading or mixing elements, screw design, and screw speed (<3000 RPM).

In one or more embodiments, the blend can include the propylene-based polymer in an amount having a low of about 60, about 70, or about 75 wt % to a high of about 80, about 90, or about 95 wt %. In one or more embodiments, the blend can include the one or more polyolefinic thermoplastic components in an amount having a low of about 5, about 10, or about 20 wt % to a high of about 25, about 30, or about 75 wt %. In one or more embodiments, the blend can include the additional elastomeric component in an amount ranging from a low of about 5, about 10, or about 15 wt % to a high of about 20, about 35, or about 50 wt %.

In one or more embodiments, the co-agents, antioxidants, and/or other additives can be introduced at the same time as the other polymer components or later downstream in case of using an extruder or Buss kneader or only later in time. In addition to the co-agents and antioxidants described, other additives can include antiblocking agents, antistatic agents, ultraviolet stabilizers, foaming agents, and processing aids. The additives can be added to the blend in pure form or in master batches.

Cured Products

The formed article (e.g., extruded article) can be a fiber, yarn or film, and may be at least partially crosslinked or cured. Cross-linking provides the articles with heat resistance which is useful when the article, such as a fiber or yarn will be exposed to higher temperatures. As used herein, the term "heat-resistant" refers to the ability of a polymer composition or an article formed from a polymer composition to pass the high temperature heat-setting and dyeing tests described herein.

As used herein, the terms "cured," "crosslinked," "at least partially cured," and "at least partially crosslinked" refer to a composition having at least about 2 wt % insolubles based on the total weight of the composition. The elastomeric polypropylene-based compositions described herein can be cured to a degree so as to provide at least about 3 wt %, or at least about 5 wt %, or at least about 10 wt %, or at least about 20 wt %, or at least about 35 wt %, or at least about 45 wt %, or at least about 65 wt %, or at least about 75 wt %, or at least about 85 wt %, or less than about 95 wt % insolubles using Xylene as the solvent by Soxhlet extraction.

In a particular embodiment, the crosslinking is accomplished by electron beam or simply "ebeam" after shaping or extruding the article. Suitable ebeam equipment is available from E-BEAM Services, Inc. In a particular embodiment, electrons are employed at a dosage of about 100 kGy or less in multiple exposures. The source can be any electron beam generator operating in a range of about 150 Kev to about 12 mega-electron volts (MeV) with a power output capable of supplying the desired dosage. The electron voltage can be adjusted to appropriate levels which may be, for example, about 100,000; about 300,000; about 1,000,000; about 2,000,000; about 3,000,000; about 6,000,000. A wide range of apparatus for irradiating polymers and polymeric articles is available.

Effective irradiation is generally carried out at a dosage between about 10 kGy (Kilogray) (1 Mrad (megarad)) to about 350 kGy (35 Mrad), including about 20 to about 350 kGy (2 to 35 Mrad), or about 30 to about 250 kGy (3 to 25 Mrad), or about 40 to about 200 kGy (4 to 20 Mrad) or about 40 to about 80 kGy (4 to 8 Mrad). In one aspect of this embodiment, the irradiation is carried out at about room temperature.

In another embodiment, crosslinking can be accomplished by exposure to one or more chemical agents in addition to the e-beam cure. Illustrative chemical agents include, but are not limited to, peroxides and other free radical generating agents, sulfur compounds, phenolic resins, and silicon hydrides. In a particular aspect of this embodiment, the crosslinking agent is either a fluid or is converted to a fluid such that it can be applied uniformly to the article. Fluid crosslinking agents include those compounds which are gases (e.g., sulfur dichloride), liquids (e.g., Trigonox C, available from Akzo Nobel), solutions (e.g., dicumyl peroxide in acetone, or suspensions thereof (e.g., a suspension or emulsion of dicumyl peroxide in water, or redox systems based on peroxides).

Illustrative peroxides include, but are not limited to, dicumyl peroxide, di-tert-butyl peroxide, t-butyl perbenzoate, benzoyl peroxide, cumene hydroperoxide, t-butyl peroctoate, methyl ethyl ketone peroxide, 2,5-dimethyl-2,5-di (tbutyl peroxy)hexane, lauryl peroxide, tert-butyl peracetate. When used, peroxide curatives are generally selected from organic peroxides. Examples of organic peroxides include, but are not limited to, di-tert-butyl peroxide, dicumyl peroxide, t-butylcumyl peroxide, α,α-bis(tert-butylperoxy)diisopropyl benzene, 2,5 dimethyl 2,5-di(t-butylperoxy) hexane, 1,1-di(t-butylperoxy)-3,3,5-trimethyl cyclohexane, -butyl-4,4-bis(tert-butylperoxy) valerate, benzoyl peroxide, lauroyl peroxide, dilauroyl peroxide, 2,5-dimethyl-2,5-di (tert-butylperoxy) hexene-3, and mixtures thereof. Also, diaryl peroxides, ketone peroxides, peroxydicarbonates, peroxyesters, dialkyl peroxides, hydroperoxides, peroxyketals and mixtures thereof may be used.

In one or more embodiments, the crosslinking can be carried out using hydrosilylation techniques.

In one or more embodiments, the crosslinking can be carried out under an inert or oxygen-limited atmosphere. Suitable atmospheres can be provided by the use of helium, argon, nitrogen, carbon dioxide, xenon and/or a vacuum.

Crosslinking either by chemical agents or by irradiation can be promoted with a crosslinking catalyst, such as organic bases, carboxylic acids, and organometallic compounds including organic titanates and complexes or carboxylates of lead, cobalt, iron, nickel, zinc, and tin (such as dibutyltindilaurate, dioctyltinmaleate, dibutyltindiacetate, dibutyltindioctoate, stannous acetate, stannous octoate, lead naphthenate, zinc caprylate, cobalt naphthenate, and the like).

In addition to using ebeaming, other forms of radiation are suitable to effect crosslinking of the elastomeric propylyene-based polymer compositions. In addition to ebeam, suitable forms of radiation include, but are not limited to, gamma radiation, x-ray, heat, photons, UV, visible light, and combinations thereof.

Exposing the yarn to ebeam may be completed either prior to winding the yarn onto a package (i.e., during the spinning process), prior to warp-knitting the yarn, after the yarn has been wound onto the package, or any combination of these. After the yarn is on the package, a single package may be exposed to ebeam, or alternatively, a plurality of packages may be treated simultaneously. When more than one package is treated simultaneously, the yarn packages can be placed in a container together such as a shipping box.

Yarns prepared from the elastomeric polypropylene-based polymer compositions may be prepared by any suitable melt-spun process. Typically, these elastomeric propylene-based polymer composition are heated to a temperature of about 220° C. to about 300° C., including about 250° C. to about 300° C., about 250° C. to about 280° C., about 260° C. to about 275° C., and about 260° C. to about 270° C. The polymer composition is then extruded through a capillary which forms a filament or yarn which is then wound onto a package. The yarn may include any suitable number of filaments such as one to eighty, including one to about twenty or one to about ten for a finer denier yarn or up to about eighty filaments or greater for a heavy denier yarn. Typical apparel fabrics may have yarns with denier 10 to about 300 denier, including about 10, about 20, about 40, about 70, and about 100, to about 300. The yarn denier may be chosen based on the desired weight of the fabric. Other useful deniers for elastomeric propylene-based elastomeric yarns include about 500 or about 1000 up to about 2000 or about 3000 denier. Heavier denier fibers and yarns are useful for personal care/hygienic stretch articles.

The process conditions of the yarns prepared from the elastomeric polypropylene-based polymer compositions result in elastomeric yarns suitable for apparel fabrics as well as a variety of other end uses such as stretch articles for personal care/hygiene (e.g., diapers, etc.) One favorable property of the yarns is the high break elongation. For stretch/elastic apparel fabrics, an elastomeric yarn is typically drafted to greater than 200% elongation depending on the denier of the yarn. The elastomeric polypropylene-based yarns can have an elongation greater than 200%, including from about 200% to about 800% or greater, including about 200% to about 600%, and about 300% to about 500%.

Another favorable property of the elastomeric polypropylene-based yarns is the tenacity which is measured in grams/denier to describe the breaking stress. Generally for elastomeric yarns, an increase in the winding speed results in an increased orientation of the yarn and improves tenacity at the expense of elongation. To the contrary, with the elastomeric propylene-based yarns of some embodiments, increasing spinning speed also results in an improved elongation of the yarn. Suitable spinning speeds include greater than about 400 m/min, including about 400 m/min to about 800 m/min, about 425 m/min to about 700 m/min and about 450 m/min to about 650 m/min.

The spinning conditions for the elastomeric propylene-based yarns that contribute to the improved properties of the yarn include not only the high spinning speeds, but also the high temperatures prior to spinning as described above. The elastomeric yarns of some embodiments may have a tenacity of about 0.5 to about 1.5 grams/denier; a load power at 200% elongation of about 0.05 to about 0.35 grams/denier; an unload power at 200% elongation of about 0.007 to about 0.035 grams/denier.

A finish may be applied to the yarns prior to winding. The finish may be any of those used in the art such as silicone based finishes, hydrocarbon oils, stearates or combinations thereof, typically used with spandex.

The elastomeric propylene-based yarns are especially useful as apparel yarns due to potential environmental exposure. The chemical composition of the polyolefin is resistant to chlorine, ozone, UV, $NO_x$, etc. unlike other elastomeric yarns such as spandex. In addition, when the yarns are crosslinked, they are also resistant to heat and can withstand typical fabric processing temperatures. For example, the yarns maintain their elastic properties at machine washing and drying temperatures that can be up to about 55° C. to about 70° C., as well as heat setting and other fabric preparation temperatures that can be as high as about 100° C. to about 195° C. Additional fabric treatment processes will depend on the yarns that are combined with the elastomeric polypropylene-based yarns. These can include scouring, bleaching, dyeing, heat-setting, and any combination of these.

Heat-setting "sets" elastomeric yarns in an elongated form. This may be completed for the yarn itself or for a fabric where the elastomeric yarn has been knit or woven into a fabric. This is also known as re-deniering, wherein an elastic yarn of higher denier is drafted, or stretched, to a lower denier, and then heated to a sufficiently high temperature, for a sufficient time, to stabilize the yarn at the lower denier. Heat-setting therefore means that the yarn permanently changes at a molecular level so that recovery tension in the stretched yarn is mostly relieved and the yarn becomes stable at a new and lower denier.

The yarns of some embodiments may be used in fabric directly (as a bare yarn) or covered with a hard yarn. Representative hard yarns include yarns made from natural and synthetic fibers. Natural fibers may be cotton, silk, or wool. Synthetic fibers may be nylon, polyester, or blends of nylon or polyester with natural fibers.

A "covered" elastomeric fiber is one surrounded by, twisted with, or intermingled with hard yarn. The hard-yarn covering serves to protect the elastomeric fibers from abrasion during weaving or knitting processes. Such abrasion can result in breaks in the elastomeric fiber with consequential process interruptions and undesired fabric non-uniformities. Further, the covering helps to stabilize the elastomeric fiber elastic behavior, so that the composite yarn elongation can be more uniformly controlled during weaving processes than would be possible with bare elastomeric fibers. There are multiple types of composite yarns, including: (a) single wrapping of the elastomer fibers with a hard yarn; (b) double wrapping of the elastomer fibers with a hard yarn; (c) continuously covering (i.e., core spinning) an elastomer fiber with staple fibers, followed by twisting during winding; (d) intermingling and entangling elastomer and hard yarns with an air jet; and (e) twisting an elastomer fibers and hard yarns together. The most widely used composite yarn is a cotton/spandex corespun yarn. A "corespun yarn" consists of a separable core surrounded by a spun fiber sheath. Elastomeric corespun yarns are produced by introducing a spandex filament to the front drafting roller of a spinning frame where it is covered by staple fibers.

Elastomeric yarns such as the elastomeric propylene-based yarns are included in fabrics to provide the fabric (or a garment containing the fabric) with elastic properties. The elastomeric yarns are knit or woven into fabrics under tension, usually at a draft (or elongation) of greater than 200%, including from about 200% to about 600% or higher. If the yarn has a break elongation of less than about 200%, it will not be suitable for this purpose.

The features and advantages of the present disclosure are more fully shown by the following examples which are provided for purposes of illustration, and are not to be construed as limiting the present disclosure in any way.

Test Methods

The strength and elastic properties of the elastic fibers were measured in accordance with the general method of ASTM D 2731-72. Three threads, a 2-inch (5-cm) gauge length and a 0-300% elongation cycle were used for each of the measurements. The samples were cycled five times at a constant elongation rate of 50 centimeters per minute. Load power (TP2), the stress on the spandex during initial extension, was measured on the first cycle at 200% extension and is reported as grams/denier. Unload power (TM2) is the stress at an extension of 200% for the fifth unload cycle and is also reported in grams/denier. Percent elongation at break (ELO) and tenacity (TEN) were measured on a sixth extension cycle. Percent set was also measured on samples that had been subjected to five 0-300% elongation/relaxation cycles. The percent set, % Set, is calculated as $$\% \text{ Set}=100(L_f-L_o)/L_o,$$

where Lo and Lf are respectively the filament (yarn) length when held straight without tension before and after the five elongation/relaxation cycles.

Additionally, instead of 0-300% stretch cycles, the elastic threads of 140 denier were stretched and cycled to a fixed tension, e.g., 15 grams of force. The stress-strain properties including load power, unload power and % Set were measured and recorded.

Alternatively, the tensile properties of the elastic fibers were measured in the first cycle to the breaking point using an Instron tensile tester equipped with a Textechno grip. The load power at 200% stretch (TT2), breaking elongation (TEL) and breaking tenacity (TTN) were recorded.

EXAMPLES

In the following examples, highly elastic yarns having good mechanical strength were made by a spinning apparatus. Polyolefin resin in the form of polymer chips was fed to an extruder. The resin was completely melted inside the extruder and then transported inside a heated and insulated transferline to a metering pump, which meters the polymer by an exact rate to a spinneret inside a spin pack, which is installed inside a spin block (aka "spin head"). The metering pump is insulated, and the pump block is heated electrically and also insulated to maintain a constant temperature.

In the following examples, a single extruder was used to supply molten polymer to two metering pumps. Each metering pump had one inlet port and four outlet streams, hence a total of 8 polymer streams were metered simultaneously to 8 individual spinnerets. A total of 4 spin packs were installed inside the spin block, and each spin pack contained two individual spinnerets and screen filter assemblies. In practice, any combination of spinnerets per spin pack can be used satisfactorily. Each spinneret contained a single round capillary; however, spinneret having multiple capillaries can also be used to make continuous yarns.

Upon being extruded from the spinneret capillary, the still-molten polymer was quenched by cooling air into solid fibers. In the following examples, two individual quench zones were used to enable complete quenching of the yarn (especially yarn having high dpf) and allow some control for quench air flow profiling to optimize yarn uniformity. Each quench zone included a blower (Q1, Q2), a duct with manually controlled dampers to allow control of gas flow rate, and a quench screen (S1, S2) to direct and diffuse the air flow to quench the fibers efficiently and uniformly.

After the fibers had been quenched and solidified, they were subsequently taken up by two driven rolls and wound up on a winder. Roll speeds were controlled such that yarn tension is optimal for winding the yarn onto a package and also for desired yarn property development. Typical relationship between the rolls and winding speeds are provided in Table 1. In this example, finish is applied to the yarn between the first and second roll using a roll applicator. However, other types of finish applicator can also be used, such as metered finish tips.

Examples 1-4

An elastomeric propylene-based polymer resin, commercially available as Vistamaxx® 1100 from ExxonMobil, was used in the following examples to make 25, 40, 55, and 70D single filament elastic yarns with surprisingly high elongation and excellent yarn strength, as shown in Table 1 (Example 1-4). All temperatures are in ° C. The results were both surprising and counterintuitive, in that resin has very high intrinsic and melt viscosities, and is generally believed to be not suitable for spinning into filament yarn. When this polymer is melted and maintained at an extremely high temperature range, it can extruded into continuous filament yarns with surprisingly excellent spinning continuity and yarn properties. It was also surprising that fibers of suitable properties can be spin in a large range of denier per filament (dpf) from 20 to 100 and possibly higher (whereas spandex yarns are typically limited to 10 dpf or lower to maintain desirable properties). Similar properties are expected for yarns including the diene and crosslinking agent.

TABLE 1

| Example # | Example 1 | Example 2 | Example 3 | Example 4 |
|---|---|---|---|---|
| Denier | 70 | 55 | 40 | 25 |
| Extruder temp, zone 1 | 135 | 135 | 135 | 135 |
| Extruder temp, zone 2 | 240 | 240 | 240 | 240 |
| Extruder temp, zone 3 | 265 | 245 | 260 | 275 |
| Transferline temp | 260 | 260 | 270 | 275 |
| Spin block temp | 263 | 263 | 268 | — |
| Polymer temp, at spin pack | 270 | 270 | 275 | 280 |
| Quench air temp, Zone 1 | 50 | 50 | 50 | 50 |
| Quench air flow, Zone 1 | 70 | 50 | 50 | 50 |
| Quench air temp, Zone 2 | 50 | 50 | 60 | 50 |
| Quench air flow, Zone 2 | 60 | 60 | 60 | 60 |
| Godet 1, mpm | 578 | 578 | 578 | 578 |
| Godet 2, mpm | 585 | 585 | 585 | 585 |
| Winding speed, mpm | 600 | 600 | 600 | 600 |
| Break tenacity, single cycle | 0.55 | 0.56 | 0.64 | 0.86 |
| Break tenacity, 6th cycle | 0.57 | 0.57 | 0.63 | 0.87 |
| Break Elongation, single cycle | 482 | 518 | 489 | 400 |
| Break elongation, 6th cycle | 498 | 523 | 499 | 417 |
| Load Power, | 0.057 | 0.054 | 0.066 | 0.126 |
| Unload Power, | 0.018 | 0.017 | 0.02 | 0.026 |

Examples 5-8

The following examples, as shown in Table 2, were prepared using a commercially available elastomeric propylene-based resin, commercially available as Vistamaxx® 2100 from ExxonMobil. Similar properties are expected for yarns including the diene and crosslinking agent.

TABLE 2

| Example # | Example 5 | Example 6 | Example 7 | Example 8 |
|---|---|---|---|---|
| Denier | 40 | 40 | 40 | 40 |
| Polymer Type | VM2100 | VM2100 | VM2100 | VM2100 |
| Extruder temp, zone 1 | 135 | 135 | 135 | 135 |
| Extruder temp, zone 2 | 240 | 240 | 240 | 240 |
| Extruder temp, zone 3 | 245 | 255 | 260 | 260 |
| Transferline temp | 245 | 255 | 270 | 270 |
| Spin block temp | 243 | 253 | 268 | 278 |
| Polymer temp, at spin pack | 250 | 260 | 275 | 285 |
| Quench air temp, Zone 1 | 50 | 50 | 50 | 50 |
| Quench air flow, Zone 1 | 50 | 50 | 50 | 50 |
| Quench air temp, Zone 2 | 60 | 60 | 60 | 60 |
| Quench air flow, Zone 2 | 60 | 60 | 60 | 60 |
| Godet 1, mpm | 578 | 578 | 578 | 578 |
| Godet 2, mpm | 585 | 585 | 585 | 585 |
| Winding speed, mpm | 600 | 600 | 600 | 600 |
| Break tenacity, single cycle | 0.81 | 0.68 | 0.64 | 0.59 |
| Break tenacity, 6th cycle | 0.88 | 0.69 | 0.63 | 0.62 |
| Break Elongation, single cycle | 408 | 424 | 485 | 515 |
| Break elongation, 6th cycle | 417 | 423 | 499 | 541 |
| Load Power, | 0.130 | 0.095 | 0.066 | 0.057 |
| Unload Power, | 0.022 | 0.019 | 0.020 | 0.019 |

While there have been described what are presently believed to be the preferred embodiments of the present disclosure, those skilled in the art will realize that changes and modifications may be made thereto without departing from the spirit of the present disclosure, and it is intended to include all such changes and modifications as fall within the true scope of the present disclosure.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also the individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±8%, or ±10%, of the numerical value(s) being modified. In addition, the phrase "about 'x' to 'y'" includes "about 'x' to about 'y'".

The invention claimed is:

1. A method for preparing a fabric including an elastomeric propylene-based polymer yarn wherein said yarn has an elongation of 200-800%, a tenacity of about 0.5 to about 1.5 grams/denier, a load power at 200% elongation of about 0.05 to about 0.35 grams/denier; and an unload power at 200% elongation of about 0.007 to about 0.035 grams/denier, said method comprising (a) providing an elastomeric propylene-based copolymer composition comprising propylene and at least one monomer selected from a $C_4$-$C_{20}$ α-olefin, a combination of ethylene and at least one $C_4$-$C_{20}$ α-olefin and one or more dienes;

(b) heating said elastomeric propylene-based polymer composition in a single extruder to a temperature of about 220° C. to about 300° C.;

(c) maintaining said elastomeric propylene-based polymer composition at a temperature of about 135° C. to about 275° C. while extruding said composition through a capillary to form the yarn;

(d) winding said yarn onto a package at a winding speed of about 450 m/min to about 650 m/min;

(e) preparing a fabric including said yarn by knitting or weaving under tension at a draft of greater than 200%, and (f) crosslinking said yarn.

2. The method of claim 1, wherein the crosslinking is effected by exposing the yarn to an ebeam.

3. The method of claim 2, wherein said yarn is exposed to the ebeam prior to winding on said package.

4. The method of claim 2, wherein said package is exposed to an ebeam as a single package or a plurality of packages in a container.

5. A method for preparing an apparel fabric including an elastomeric propylene-based polymer yarn wherein said yarn has an elongation of 200-800%, a tenacity of about 0.5 to about 1.5 grams/denier, a load power at 200% elongation of about 0.05 to about 0.35 grams/denier; and an unload power at 200% elongation of about 0.007 to about 0.035 grams/denier, said method comprising:

(a) providing an elastomeric propylene-based providing an elastomeric propylene-based copolymer composition comprising propylene and at least one monomer selected from a $C_4$-$C_{20}$ α-olefin, a combination of ethylene and at least one $C_4$-$C_{20}$ α-olefin and one or more dienes;

(b) heating said elastomeric propylene-based polymer composition in a single extruder to a temperature of about 220° C. to about 300° C.;

(c) maintaining said elastomeric propylene-based polymer composition at a temperature of about 135° C. to about 275° C. while extruding said composition through a capillary to form the yarn;

(d) winding said yarn onto a package at a winding speed of about 450 m/min to about 650 m/min;

(e) preparing a warp comprising a plurality of said yarns;

(f) exposing said yarns to an ebeam to crosslink said yarns;

(g) taking up the yarn on a beam; and (h) warp knitting an apparel fabric under tension at a draft of greater than 200%.

* * * * *